United States Patent [19]

Fossum et al.

[11] Patent Number: 5,060,981

[45] Date of Patent: Oct. 29, 1991

[54] TRANSPARENT OVERLAY FOR PROTECTING A DOCUMENT FROM TAMPERING

[75] Inventors: Douglas K. Fossum; Susan K. Jongewaard; John W. McConville, all of St. Paul, Minn.

[73] Assignee: Minnesota Mining and Manufacturing Company, St. Paul, Minn.

[21] Appl. No.: 409,144

[22] Filed: Sep. 19, 1989

[51] Int. Cl.[5] ..... B42D 15/00

[52] U.S. Cl. ..... 283/109; 283/75; 283/85; 283/87; 283/90; 283/91; 283/904

[58] Field of Search ..... 283/109, 74, 75, 77, 283/85, 86, 87, 91, 90, 904

[56] References Cited

U.S. PATENT DOCUMENTS

| | | | |
|---|---|---|---|
| 3,801,183 | 4/1974 | Sevelin et al. | 350/105 |
| 3,898,086 | 8/1975 | Franer et al. | 96/28 |
| 4,099,838 | 7/1978 | Cook et al. | 350/105 |
| 4,688,894 | 8/1987 | Hockert | 350/105 |
| 4,691,993 | 8/1987 | Porter et al. | 350/105 |
| 4,713,365 | 12/1987 | Harrison | 503/227 |
| 4,847,238 | 7/1989 | Jongewaard et al. | 503/227 |
| 4,911,478 | 3/1990 | Oshikoshi et al. | 283/109 |
| 4,928,996 | 5/1990 | Oshikoshi et al. | 283/109 |

FOREIGN PATENT DOCUMENTS 2040807 9/1980 United Kingdom .

OTHER PUBLICATIONS

P. Gregory, Chem. Brit., 25, 47 (1989).

C. J. Bent et al., J. Soc. Dyers, Colour, 85, 606 (1969).

J. Griffiths and F. Jones, J. Soc. Dyers Colour, 93, 176 (1977).

J. Aihara et al., Am. Dyest Rep., 64, 46 (1975).

C. E. Vellins, "The Chemistry of Synthetic Dyes", K. Venkataraman, ed., vol. VIII, 191, Acadamic Press, New York, 1978.

*Primary Examiner*—Paul A. Bell

*Attorney, Agent, or Firm*—Gary L. Griswold; Walter N. Kirn; Robert H. Jordan

[57] ABSTRACT

A transparent overlay that can protect a document from tampering has a transparent cover sheet, a layer of hot-melt adhesive over one surface of the transparent cover sheet, and a polymeric image-receiving layer over the exposed face of said hot-melt adhesive layer. The transparent cover sheet can be a simple thermoplastic film but preferably is retroreflective sheeting which can bear a pattern or legend that is noticeable only when viewed retroreflectively. When the polymeric image-receiving layer is dye-receptive, it can be imaged by using a thermal printing head with a dye-donor element. A preferred polymeric image-receiving layer that is dye-receptive is chlorinated poly(vinylchloride).

16 Claims, 1 Drawing Sheet

TRANSPARENT OVERLAY FOR PROTECTING A DOCUMENT FROM TAMPERING

CROSS-REFERENCE TO RELATED APPLICATION

This application is related to an application entitled "Transparent Tamper-Indicating Document Overlay", filed of even date and commonly assigned herewith and incorporated herein by reference.

BACKGROUND OF THE INVENTION

1. Field of the Invention

The invention is concerned with transparent overlays to protect documents from tampering and is especially concerned with such overlays which contain patterns and legends that are difficult to counterfeit and thus also function to authenticate the documents.

2. Description of the Related Art

Documents often have adherent transparent overlays to provide protection against dirt, moisture, and general wear and tear. A typical transparent overlay has a plastic film bearing an aggressive adhesive layer by which it can be permanently adhered to the face of a document. When the plastic film incorporates a message such as a design that does not obscure the underlying information, a transparent overlay can afford an additional degree of protection, especially when the message-containing plastic film is difficult to remove without being destroyed and also is difficult to counterfeit. For example, many credit cards presently are made to exhibit holographic images which may be transparent but often are opaque and thus confined to an area not bearing information.

Even when the plastic film of an overlay is so fragile as to inhibit removal as a single piece or, if removed will tend to be so contorted that it cannot be reapplied, a nagging concern remains that a clever, deft person might be able to remove it without undue damage (e.g., by the use either of hot or exceedingly cold temperatures) and to alter the face of the document (e.g., by replacing a portrait or photograph that identifies the bearer). Even when doing so would be discernable under expert examination, ordinary use of most documents usually precludes such an examination except under extraordinary circumstances. For example, when the document is a passport, a customs official rarely is allowed more than a minute or two to check both the document and its bearer unless there is some external evidence to suggest a more careful examination.

A transparent overlay which can contain a pattern or legend that does not obscure underlying information is disclosed in U.S. Pat. No. 3,801,103 (Sevelin et al.). That pattern or legend is invisible or only faintly visible to the naked eye under diffuse light and becomes readily legible only when viewed retroreflectively. Such overlays are currently manufactured and sold as CONFIRM brand security films by the Minnesota Mining and Manufacturing Company.

Because the CONFIRM brand security film is fragile and has a layer of an aggressive adhesive by which it is bonded permanently to documents, it may be impossible to peel the sheeting from a document and reapply it without leaving a readily noticeable evidence of tampering. Nevertheless, some issuers of documents request even greater assurance against tampering.

Subsequent to the aforementioned U.S. Pat. No. 3,801,103, a number of patents have issued disclosing other transparent overlays, each of which can be imaged with a pattern or legend that is noticeable only when viewed retroreflectively and can be adhesively bonded to a document without obscuring the face of the document. See, for example, U.S. Pat. No. 4,099,838 (Cook et al.), the overlay of which has the additional feature of causing the color of the reflection in the background areas to be different from the color of the reflection in the image areas. See also U.S. Pats. No. 4,688,894 (Hockert) and No. 4,691,993 (Porter et al.), each of which discloses a transparent overlay that functions in the same way as that of the Sevelin patent while having the added capability of permitting an authenticating message to be formed in the overlay after it has been adhesively bonded to a document. However, none of the transparent overlays of those three patents offers better assurance against unnoticeable tampering than does the overlay of U.S. Pat. No. 3,801,103 or the CONFIRM brand security film.

Thermal Imaging Art

U.S. Pat. No. 4,713,365 (Harrison) concerns a previously known thermal transfer system for obtaining prints from a color video camera for such purposes as to apply a multicolor image to an ID card. This is done by placing a dye-donor element face-to-face with a dye-receiving sheet. A line-type thermal printing head applies heat from the back of the dye-donor element to transfer color selectively to the dye-receiving sheet, and this process may be repeated using two additional colors to provide a three-color dye transfer image. Then a transparent cover sheet is laminated over the image using the hot-melt adhesive of Harrison's invention, namely, a hot-melt adhesive "comprising a linear, random copolyester of one or more aromatic dibasic acids and one or more aliphatic diols, modified with up to 30 mole % of one or more aliphatic dibasic acids, said copolyester having a melt viscosity of between about 1,000 and about 20,000 poise at 150° C." (claim 1). Preferred transparent cover sheets are polymeric films such as polycarbonate or a polyester such as poly(ethyleneterephthalate) and preferably cover both the front and back faces of the so-called thermal print element that bears the dye transfer image.

In a similar thermal transfer system, the donor element employs a pigment dispersed in a wax-containing coating as described, for instance, in U.S. Pat. No. 3,898,086 (Franer et al.). While pigments tend to provide improved light fastness compared to dyes, the use of pigments limits the continuous tone capability of the image. A recent review has described the transfer mechanism as a "melt state" diffusion process quite distinct from the sublimation attending textile printing. [See: P. Gregory, *Chem. Brit.*, 25, 47 (1989)].

In another thermal imaging system, a donor sheet is coated with a pattern of one or more dyes, contacted with fabric to be printed, and heat is uniformly administered, sometimes with concomitant application of a vacuum. The transfer process has been much studied, and it is generally accepted that the dyes are transferred by sublimation in the vapor phase. Pertinent references include: C. J. Bent et al., *J. Soc. Dyers Colour*, 85, 606 (1969); J. Griffiths and F. Jones, ibid., 93, 176, (1977); J. Aihara et a., *Am. Dyest. Rep.*, 64, 46 (1975), C. E. Vellins in "The Chemistry of Synthetic Dyes", K. Venkataraman, ed., Vol. VIII, 191, Academic Press, N.Y. 1978.

SUMMARY OF THE INVENTION

The invention provides a transparent overlay to be permanently laminated to a document, which overlay can be imaged with information associated with the document, e.g., the bearer's portrait. Because the image is part of the overlay, it would be necessary to destroy the overlay in order to tamper with the image after the overlay has been laminated to a document. The transparent flexible cover sheet of the overlay of the invention preferably incorporates a pattern or legend that is readily legible only when viewed retroreflectively, e.g., a transparent sheet of any of the aforementioned U.S. Pat. Nos. 3,801,103; 4,099,838; 4,688,894; and 4,691,933. As noted above, each such sheeting incorporates means for creating a pattern or legend that is readily legible only when viewed retroreflectively and that is obscure, i.e., is invisible or only faintly visible to the naked eye, under diffuse light. Because such a sheeting is typically flimsy, it is virtually impossible to remove a single, undistorted piece from a substrate to which it has been bonded with an aggressive adhesive. Because of its sophisticated construction, persons wanting to tamper should be unable to reproduce its retroreflectively viewable pattern or legend. Furthermore, the transparent sheeting of any of those patents can prevent two documents from being cut apart and combined into a single, fraudulent document by fabricating those documents with retroreflective patterns or legends that are difficult or impossible to match, and the intersection between the two reflective areas would appear black when viewed retroreflectively.

The transparent cover sheet of the novel overlay can be a simple thermoplastic film, because even if someone were able to remove that film from a document as a single piece without undue distortion, it would carry at least part of any image that had been formed in the polymeric image-receiving layer, thus making it virtually impossible to reconstruct the overlay-document laminate after tampering.

Briefly, the overlay of the invention comprises (a) a transparent flexible cover sheet, (b) a layer of hot-melt adhesive over one surface of said transparent cover sheet, which adhesive has a Tg of at least about −15° C., and (c) a polymeric image-receiving layer over the exposed face of said hot-melt adhesive layer, which image-receiving layer is no more than about 50 μm (microns) in thickness.

By "transparent" as used to characterize the novel overlay and its cover sheet, is meant that an underlying image can be readily viewed through the overlay and its covering.

Although the hot-melt adhesive (like that of the aforementioned U.S. Pat. No. 4,713,365 which is the preferred adhesive in the novel overlay) typically preferably forms strong, peel-resistant bonds, it does not need to do so. Hot-melt adhesives which would fail in a composite of that patent are quite useful in the novel overlay, because delamination of the novel overlay and a protected document would destroy the overlay and with it, the image. For example, when the image includes a portrait, it would be impossible to substitute another portrait without somehow removing as much of the polymeric image-receiving layer as contains the portrait, and with it at least the adjacent portion of the hot-melt adhesive layer. It also would be necessary to reconstruct those layers and then to apply a new portrait. Anyone having the skill to do all of that should have the skill to counterfeit the document from the beginning, while finding it easier to do so.

The polymeric image-receiving layer of the novel overlay can be imaged by any of several known techniques such as that suggested in the aforementioned U.S. Pat. No. 4,713,365. That is, when a dye-donor element is positioned face-to-face with the image-receiving layer of the novel overlay, a thermal print head can apply heat from the back of the dye-donor element to transfer color selectively to the image-receiving layer. This process can be repeated using two additional colors to provide a three-color dye transfer image. Other useful techniques employ dry toner, liquid toner, or ink-jet printing.

Considering that the polymeric image-receiving layer covers the hot-melt adhesive layer of the novel overlay, it is remarkable that (in testing to date) whenever its thickness has not exceeded about 50 μm, bonds formed with prototype transparent overlays of the invention have been substantially as strong and permanent as are bonds formed with overlays that are identical except for omission of the polymeric image-receiving layer.

When the image-receiving layer is imaged from a dye-donor element, the resulting images are surprisingly sharp, considering that heat applied by a thermal print head could be expected to cause local softening of the underlying hot-melt adhesive layer and thus blurring of the image. Although the local softening does occur, as evidenced by the tendency of the image to migrate into the adhesive, the expected blurring has not occurred.

It also is remarkable that upon applying heat to laminate the novel overlay to the face of a document, images formed in the polymeric image-receiving layer can retain their original sharpness.

DETAILED DESCRIPTION OF ILLUSTRATIVE EMBODIMENTS

Figure 1:
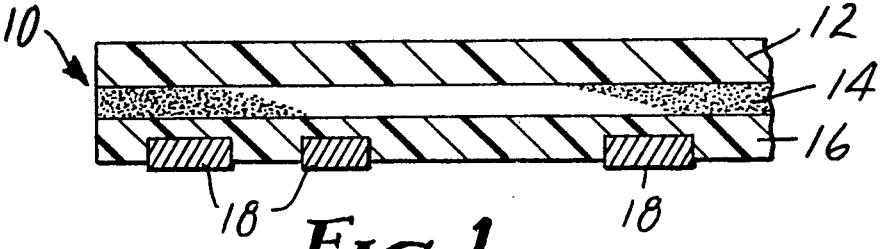

A preferred class of materials for the polymeric image-receiving layer comprises chlorinated poly(vinylchloride) having a chlorine content of about 62–74%, a Vicat B value of about 110°–170° C., a Tg no lower than about 80° C., and an inherent viscosity of about 0.4–1.5. That class of polymeric image-receiving layers is disclosed and claimed in U.S. Pat. No. 4,847,238 (Jongewaard et al.) which is incorporated herein by reference. Image-receiving layers of that class of chlorinated poly(vinylchloride) can be quite thin and still allow high density images to be transferred from a dye-donor element by the use of a thermal print head.

Other useful, but less-preferred, classes of materials for the polymeric image-receiving layer include poly(vinylchloride)s, polyesters, cellulosic derivatives, polyvinylpyrollidones, polycarbonates, butyral vinyl acetates, acrylates, methacrylates, and styrene/acrylonitrile copolymers. As compared to chlorinated poly(vinylchloride), it is more difficult to coat the polycarbonates to the preferred thicknesses; poly(vinylchloride)s, and butyral vinyl acetates tend to have a lower Tg and so are less resistant to image distortion; and the others have lower receptivity to dyes. It should be feasible to enhance dye-receptivity by blending with additives known to be useful for that purpose, e.g., surfactants.

The polymeric image-receiving layer preferably is as thin as possible while substantially uniformly covering the hot-melt adhesive layer. At thicknesses substantially greater than about 50 μm, the polymeric image-receiving layer may tend to inhibit the formation of a strong, permanent bond between the novel overlay and a document that is to be protected. A presently preferred range of thicknesses is from about 8 to about 25 μm, and ideally at the low end of that range for use on a smooth document. Such thicknesses are so small that it may be necessary to calculate them from the weights of deposited materials rather than from direct measurement.

The Tg of the major polymeric component of the polymeric image-receiving layer preferably is from about 60° to about 150° C. When its Tg is substantially less than that preferred range, there is danger that an image may gradually become blurred over an extended period of time. A Tg substantially greater than that preferred range could require undesirably high bonding temperatures in regard both to energy consumption and safety.

The hot-melt adhesive of the novel overlay preferably forms strong bonds to paper and other materials of which documents to be protected are made. A preferred class of hot-melt adhesives that forms strong bonds is linear, random copolyesters of one or more aromatic dibasic acids and one or more aliphatic diols, modified with up to about 30 mole % of one or more aliphatic dibasic acids, as in the above-cited U.S. Pat. No. 4,713,365. Among other useful classes of hot-melt adhesives are ethylene/vinyl acetate (EVA) copolymers, ethylene/acrylic acid (EAA) copolymers, ethyene/ethyl acrylate (EEA) copolymers, ethylene/-methyl acrylate (EMA) copolymers, and polyethylene.

The Tg of the hot-melt adhesive of the novel overlay should be from about −15° to about 150° C. At substantially lower Tg, there would be a danger of image blurring, especially when the image-receiving layer is imaged with dye by the technique described in U.S. Pat. No. 4,713,365. At a Tg substantially higher than said preferred range, it would be necessary to employ undesirably high temperatures to laminate the novel overlay to a document. Preferably the Tg of the hot-melt adhesive is from about 40° C. to about 100° C.

The layer of hot-melt adhesive preferably is at least about 50 μm in thickness when the document to which the overlay is to be applied is porous like paper. A thickness of about 25 μm would be adequate when the document is smooth, e.g., a plastic film or plastic-coated paper. Even when the document is smooth, the thickness of the hot-melt adhesive preferably is at least about 50 μm when the transparent covering of the novel overlay is retroreflective sheeting, and dye is used to image the polymeric image-receiving layer. Substantially thinner layers have resulted in migration of the imaging dye from the image-receiving layer into the bead-bond layer of the retroreflective sheeting. On the other hand, if the thickness of the hot-melt adhesive were to exceed about 200 μm, this would be wasteful of raw materials. Furthermore, it can be difficult to form uniform coatings of the hot-melt adhesive at substantially greater thicknesses.

When the transparent flexible cover sheet of the novel overlay is a simple thermoplastic film, the face of the document to be protected preferably is first imaged (e g., by printing) to show a pattern that differs in position from document to document. Then, if someone were to attempt to combine two documents (e.g., by cutting out a photograph from one passport to use with a different passport), it would be virtually impossible to match their background patterns.

When the transparent flexible cover sheet of the novel overlay is a simple thermoplastic film, it preferably is biaxially oriented poly(ethylene terephthalate), as such films are typically scratch-resistance and have good transparency and good dimensional stability over a wide range of temperatures. Other useful simple thermoplastic films include polycarbonates, polyimides, cellulose acetate, and polyethylene. A simple transparent film preferably is so thin that any effort to peel the novel overlay from a document would either cause the transparent film to break or become distorted.

When dye is used to image the polymeric image-receiving layer and the transparent cover sheet is retroreflective sheeting, the layer of hot-melt adhesive can be quite thin by employing between the adhesive and the transparent cover sheet, a barrier layer that inhibits the migration of the dye into the bead-bond layer of the retroreflective sheeting. A preferred barrier layer is made from Scotch TM Y-110 release solution (from 3M Co.) which is polyvinyl alcohol dissolved in isopropyl alcohol and deionized water. This barrier material is effective in thicknesses on the order of about 1 μm.

In using the novel overlay to protect a document, a preferred procedure involves the steps of (a) preprinting the document with information standard to all like documents, e.g., with boxes labeled to receive a bearer's name, address, birth date, etc., (b) forming in the image-receiving layer a mirror image of information specific to the bearer, optionally including the bearer's portrait, and (c) bonding the overlay over the standard information by means of the hot-melt adhesive layer. If, subsequently, someone were to be able to peel off the overlay, it would carry with it at least some of the image, leaving the standard information and any remaining portion of the image on the document. Then to change the image, one would need to erase any part of the image that remains on both the document and the overlay while constructing a new image on either the document or the overlay, because it would be virtually impossible to reconstruct the images at both surfaces to make them match upon reassembly.

THE DRAWING

Figure 2:
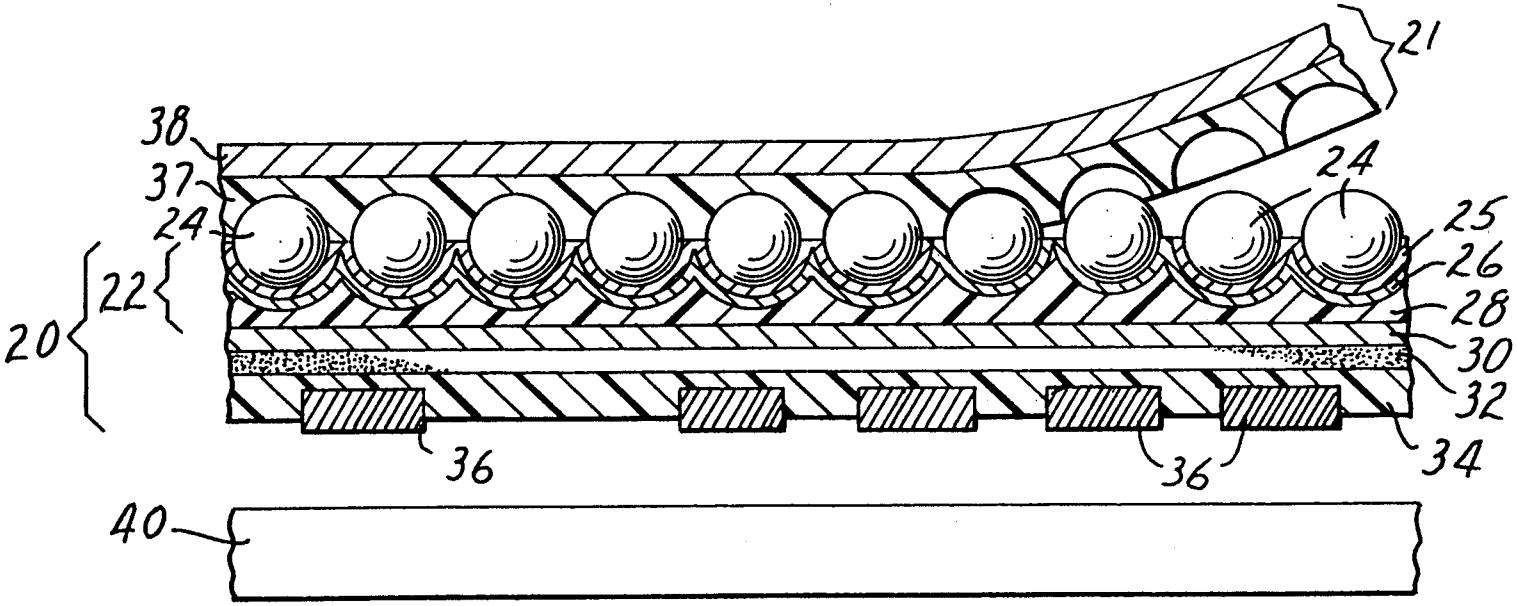

The invention may be more easily understood in reference to the drawing, all figures of which are schematic. In the drawing:

FIG. 1 is a fragmentary edge view of a transparent overlay of the invention; and FIG. 2 is a fragmentary edge view of another transparent overlay of the invention which incorporates a pattern that is noticeable only when viewed retroreflectively, which overlay is shown in position to be laminated to the face of a document to protect against tampering, and with its temporary carrier being stripped off.

In FIG. 1, a transparent overlay 10 has a transparent flexible cover sheet 12, specifically a thermoplastic film. On the cover sheet is a hot-melt adhesive layer 14 and a polymeric image-receiving layer 16, the exposed surface of which has received a mirror image 18, e.g., formed by a thermal transfer system (not shown).

In FIG. 2, a transparent overlay 20, with removable carrier 21 attached, has a flexible cover sheet 22 including a monolayer of glass beads 24, a selectively imprinted transparent lacquer layer 25, a transparent dielectric layer 26 of optical thickness approximately one-fourth of the wavelength of light, and a bead-bond layer 28. The lacquer layer provides a pattern or legend that is noticeable only when viewed retroreflectively. The transparent overlay 20 also has a barrier layer 30 to prevent dye migration into the bead-bond layer 28, a hot-melt adhesive layer 32, and an image-receiving layer 34, the exposed surface of which has received a mirror image 36.

The transparent overlay 20 is assembled by cascading a substantial monolayer of glass beads onto a release material 37 (typically attached to a paper layer 38) of the carrier 21, selectively printed to provide the lacquer layer 25, and then vapor-coated with the dielectic layer 26, followed by the coating of layers 28, 30, 32, and 34. After forming the mirror image 36 and laying the image-receiving layer 34 onto a substrate 40 (such as a page of a passport), heat is applied to laminate the transparent overlay 20 to the substrate, after which the temporary carrier 21 is peeled off as indicated in FIG. 2.

EXAMPLES

The invention will now be further explained with the following illustrative examples.

Materials used in the examples were:

| Trade Name | Composition | Source |
|---|---|---|
| TEMPRITE 678 × 512 | Chlorinated poly(vinyl-chloride), chlorine content 62.5% | B. F. Goodrich |
| DAF 899 | Ethylene/acrylic acid copolymer resin film | Dow Chemical |
| ELVAX 550 | Ethylene/vinyl acetate copolymer resin | E. I. du Pont |
| EPON 1002 | Epoxy Resin | Shell Chem. Co. |
| VITEL PE 200 | Low-molecular-weight copolyester | Goodyear |
| VITEL PE 222 | Low-molecular-weight copolyester | Goodyear |
| FERRO 1247 | Heat Stabilizer | BASF |
| UVINUL N539 | UV Stabilizer | BASF |
| FLUORAD FC340 | Fluorocarbon surfactant | 3M |
| ATLAC 382ES | Bisphenol A fumaric acid polyester | Koppers |
| TINUVIN 328 | UV Stabilizer | Ciba-Geigy |
| DOBP | UV Stabilizer 4-dodecyloxy-2-hydroxybenzophenone | Eastman Kodak Chem |

Also used in the examples were:

Thermal Printer A

Thermal printer A has a Kyocera raised glaze thin film thermal print head with 8 dots/mm and 0.25 watts per dot. In normal imaging, the electrical energy varied from 2.64 to 6.43 joules/cm$^2$, which corresponded to head voltages from 9 to 20 volts with a 4 msec pulse. Grey scale images were produced by using 32 electrical levels, produced by pulse width modulation or by variation of applied voltage.

Thermal Printer B

Commercially available thermal dye transfer printer, Model SV6500 from Eastman Kodak.

Dye-Donor Element A

Hitachi VY-S100A dye-donor element.

Dye-Donor Element B

Mitsubishi CK 100L dye-donor element.

90° Peel Test

Prepare sample and allow to stand at room temperature for at least 16 hours. Cut 1-inch (2.54 cm) wide strips and evaluate for adhesion with an Instron Model 1122 Universal Tester at an angle of 90 degrees at a rate of 5 inches/min. (12.5 cm/min.).

In the examples, all amounts are expressed as parts by weight unless otherwise indicated.

EXAMPLE 1

A transparent, retroreflective cover sheet as illustrated in FIG. 2 was imprinted to bear a legend that could be seen only in retroreflective light. Its hot-melt adhesive layer was DAF 899 having a thickness of about 50 μm. Onto the hot-melt adhesive layer the following solution was coated, using a #8 wire-wound Mayer bar:

| Amount | Component |
|---|---|
| 0.20 | TEMPRITE 678 × 512 |
| 0.25 | ATLAC 382ES |
| 0.04 | EPON 1002 |
| 0.04 | VITEL PE 200 |
| 0.05 | FLUORAD FC 430 |
| 0.15 | TINUVIN 328 |
| 0.04 | UVINUL N539 |
| 0.05 | THERM-CHECK 1237 |
| 0.08 | DOBP |
| 4.56 | tetrahydrofuran |
| 1.85 | 2-butanone |

The coating, which had a wet thickness of 18 μm, was air-dried to provide an image-receiving layer having good dye-receptivity. This was placed in contact with a cyan Dye-Donor Element A and imaged using Thermal Printer A. After imaging, the construction provided good reproduction of the variable-density input with no sticking or ripping of the dye donor element. Yellow and magenta dye donor elements were then imaged on separate overlays with similar success.

COMPARATIVE EXAMPLE 1-C

A transparent overlay was made as in example 1 except omitting the image-receiving layer. When its hot-melt adhesive layer was placed in contact with a cyan Dye-Donor Element A and imaged using Thermal Printer A, as in Example 1, an image of unacceptably low density was formed on the adhesive layer. In all areas where dye had transferred to the adhesive layer, there was sticking and tearing of Dye-Donor Element A. The same results were experienced with yellow and magenta.

EXAMPLE 2

A transparent overlay was made as in Example 1 except that its cover sheet was biaxially oriented poly(ethylene terephthalate) film 50μm in thickness. Its hot-melt adhesive layer was ELVAX 550 having a thickness of about 75 μm, and its image-receiving layer was identical to that of Example 1. This was imaged with Thermal Printer A as in Example 1 except using a yellow, magenta, cyan Dye-Donor Element B series. Image density and resolution were good. The maximum reflective optical densities obtained from a GRETAG D186 densitometer were 1.15 for yellow, 1.06 for magenta, and 1.23 for cyan.

This imaged transparent overlay of the invention was placed with its image-receiving layer in contact with ordinary copy paper, and both were passed at 100° C. through a hot-roll pressure laminator (TLC Model 600 desk-top laminator). Image quality remained good after lamination. The 90° Peel Test of the final construction resulted in splitting within the paper layer.

EXAMPLE 3

A transparent, retroreflective cover sheet as shown in FIG. 2 having smooth urethane beadbond was used to make a transparent overlay of the invention. The beadbond was knife-coated with a 125 μm wet layer of VITEL PE222 adhesive in methyl ethyl ketone (50% solids having a solution viscosity of 2000 cps). The coating was dried in an oven. The image-receptor solution of Example 1 was coated over the dried VITEL layer using a #8 Mayer bar (18 μm wet thickness) and hot air dried. A 3-color Dye Donor Element B series was put in contact with the dried image-receiving layer which was imaged on Printer A. The resulting image had good resolution. Imaged overlays were laminated to ordinary copy paper as in Example 2 (except at 150° C.) with no loss in image quality. Laminated samples were aged for 4 months in an oven at 65° C. Image density and resolution remained good throughout this time period.

EXAMPLE 4

Example 3 was repeated four times with the following changes:

A. Diagonal stripes were printed on the beadbond with a clear SCOTCH Brand Y110 solution and dried to a thickness of a few micrometers.

B. The VITEL PE222 copolyester adhesive was coated over the release strips and dried to thicknesses of about 25, 31, 47 and 5D μm, respectively.

C. Using Thermal Printer B, the image-receiving layer of each of the four samples was imaged to simulate an ID card containing a color portrait. Each of the resulting images had good resolution and density, both before and after laminating to paper. After 2 months aging at 65° C., images on the samples having the 25 and 31 μm VITEL copolyester adhesive layers exhibited considerable blur (dye migration) except in areas where the SCOTCH Brand Y110 layer was present and were unnoticeably changed in those areas and in all areas of the two samples having thicker VITEL polyester adhesive layers.

EXAMPLE 5

Three transparent overlays were made as in Example 2 except that the polyester cover sheet as 175 μm in thickness and the hot-melt adhesion layer was VITEL PE222 polyester having a thickness of about 125 μm. The three overlays differed in that the image-receiving solution was coated with three different wire-wound Mayer bars, namely, #3, #8 and #16, to provide wet thicknesses of 7, 18, and 36 μm, respectively. For comparison, a fourth overlay omitted the image-receiving solution. These transparent overlays were then laminated to a white rigid PVC substrate (0.37 μm in thickness) with a hot-roll pressure laminator at 150° C.

| Mayer Bar | 90° Peel Test Value (N/m) |
|---|---|
| #3 | 1440 |
| #8 | 1210 |
| #16 | 920 |
| None | 1210 |

These results show that adequate adhesion is maintained in spite of the presence of an image-receiving layer between the adhesive and the substrate. A peel test performance of at least about 500 N/m is considered to provide sufficient delamination resistance for most applications.

EXAMPLE 6

Pieces of each of the overlays of Example 5 were imaged using the test printer and method in Example 2. The resultant images on each of the overlays containing image-receiving layers were uniform with good density and resolution. The image on the comparative overlay (no image-receiving layer) was unacceptable due to sticking of the dye-donor element causing limited resolution and poor continuous-tone capability. Each of the imaged overlays was laminated to white PVC as in Example 5. Image density and resolution remained unchanged. The 90° Peel Test resulted either in tearing of the overlay or splitting of the image between the overlay and substrate, thus indicating good resistance to tampering.

Various modifications and alterations of this invention will become apparent to those skilled in the art without departing from the scope and spirit of this invention.

What is claimed is:

1. A document having a transparent overlay comprising:

(a) a transparent cover sheet, (b) a layer of hot-melt adhesive over one surface of said transparent covering, which adhesive has a Tg of at least about −15° C., and (c) a polymeric image-receiving layer over the exposed face of said hot-melt adhesive layer, which image-receiving layer is no more than about 50 μm in thickness, said overlay being bonded to the document by said hot-melt adhesive.

2. A document as defined in claim 1 wherein said polymeric image-receiving layer bears an image which is protected from tampering by the transparent overlay.

3. A document as defined in claim wherein said transparent cover sheet comprises retroreflective sheeting.

4. A document as defined in claim wherein said retroreflective sheeting bears a pattern or legend that is readily legible only when the document is viewed retroreflectively.

5. A document as defined in claim wherein said transparent cover sheet is a thermoplastic film.

6. A transparent overlay by which a document can be protected from tampering, said overlay comprising:

(a) a transparent flexible cover sheet (b) a layer of hot-melt adhesive over one surface of said transparent cover sheet, which adhesive has a Tg of at least about −15° C., and (c) a polymeric image-receiving layer over the exposed face of said hot-melt adhesive layer, which image-receiving layer is no more than about 50 μm in thickness.

7. A transparent overlay as defined in claim 6 wherein said transparent cover sheet is a thermoplastic film.

8. A transparent overlay as defined in claim 6 wherein said transparent cover sheet is retroreflective sheeting which incorporates means for bearing a pattern or legend that is readily legible only when viewed retroreflectively.

9. A transparent overlay as defined in claim 6 wherein the major polymeric component of said polymeric image-receiving layer is selected from poly(vinylchloride)s, polyesters, cellulosic derivatives, polyvinylpyrollidones, polycarbonates, butyral vinyl acetates, acrylates, methacrylates, and styrene/acrylonitrile copolymers.

10. A transparent overlay as defined in claim 9 wherein the Tg of said major polymeric component is from about 60° to about 150° C.

11. A transparent overlay as defined in claim 6 wherein said polymeric image-receiving layer comprises chlorinated poly(vinylchloride) having a Tg no lower than about 80° C., and an inherent viscosity of about 0.4-1.5.

12. A transparent overlay as defined in claim 6 wherein said hot-melt adhesive has a Tg of from about 40° C. to about 100° C.

13. A transparent overlay as defined in claim 12 wherein said hot-melt adhesive comprises a linear, random copolyester of one or more aromatic dibasic acids and one or more aliphatic diols, modified with up to about 30 mole % of one or more aliphatic dibasic acids.

14. A transparent overlay as defined in claim 6 wherein the thickness of said hot-melt adhesive is from about 25 to about 200 μm.

15. A transparent overlay as defined in claim 6 wherein the thickness of the polymeric image-receiving layer is from about 8 to about 25 mm.

16. A transparent overlay as defined in claim 1 and further comprising a barrier layer between the hot-melt adhesive layer and the cover sheet.

* * * * *

UNITED STATES PATENT AND TRADEMARK OFFICE

CERTIFICATE OF CORRECTION

PATENT NO. : 5,060,981

DATED : October 29, 1991

INVENTOR(S) : Douglas K. Fossum et al.

It is certified that error appears in the above-identified patent and that said Letters Patent is hereby corrected as shown below:

In Column 9, Line 39, the number "5D" should read --50--.

In Column 10, Line 53, Insert the number --2-- between the words "claim" and "wherein".

In Column 10, Line 55, Insert the number --3-- between the words "claim" and "wherein".

In Column 10, Line 59, Insert the number --2-- between the words "claim" and "wherein".

Signed and Sealed this

Twenty-third Day of March, 1993

*Attest:*

STEPHEN G. KUNIN

*Attesting Officer*

*Acting Commissioner of Patents and Trademarks*